United States Patent [19]

Hirakawa et al.

[11] 4,316,761

[45] Feb. 23, 1982

[54] SINGLE FACER

[75] Inventors: Tadashi Hirakawa; Hiroaki Sasashige, both of Mihara; Hiroyuki Takenaka; Keiichi Katayama, both of Hiroshima, all of Japan

[73] Assignee: Mitsubishi Jukogyo Kabushiki Kaisha, Japan

[21] Appl. No.: 178,459

[22] Filed: Aug. 15, 1980

[30] Foreign Application Priority Data

Aug. 17, 1979 [JP] Japan ..... 54/113107[U]

[51] Int. Cl.[3] ..... B31F 1/00

[52] U.S. Cl. ..... 156/472; 226/171

[58] Field of Search ..... 226/170, 171, 172, 173; 156/470, 471, 472, 473

[56] References Cited

U.S. PATENT DOCUMENTS

| | | | |
|---|---|---|---|
| 545,354 | 8/1895 | Ferres | 156/473 |
| 1,519,280 | 12/1924 | Wandel | 156/470 X |
| 1,609,318 | 12/1926 | Smith | 156/473 X |
| 2,630,618 | 3/1953 | Sewell | 226/171 |
| 2,714,340 | 8/1955 | Brown | 156/470 X |

*Primary Examiner*—Edward J. McCarthy

*Attorney, Agent, or Firm*—Bernard, Rothwell & Brown

[57] ABSTRACT

A single facer includes a pressure member adjacent the lower corrugating roll to apply pressure for effecting bonding of a corrugated web and a liner web, the liner web being adjacent the surface of the pressure member. The pressure member is provided, in the area facing the lower corrugating roll, with an arcuate surface having a curvature equal to or exceeding that of an arc extending through the tips of the flutes of the corrugating roll. The pressure member is of a circumferential length at least exceeding the distance between two adjacent flutes of the corrugating roll. In order to reduce the friction between the arcuate surface of the pressure member and the liner web passing thereover, a conveyor in the form of an endless belt is disposed with a portion thereof extending between the arcuate surface of the pressure member and the liner web. This portion of the endless belt is movable in the same direction as the periphery of the lower corrugating roll and is movable at a speed equal to the peripheral speed of the lower corrugating roll.

3 Claims, 7 Drawing Figures

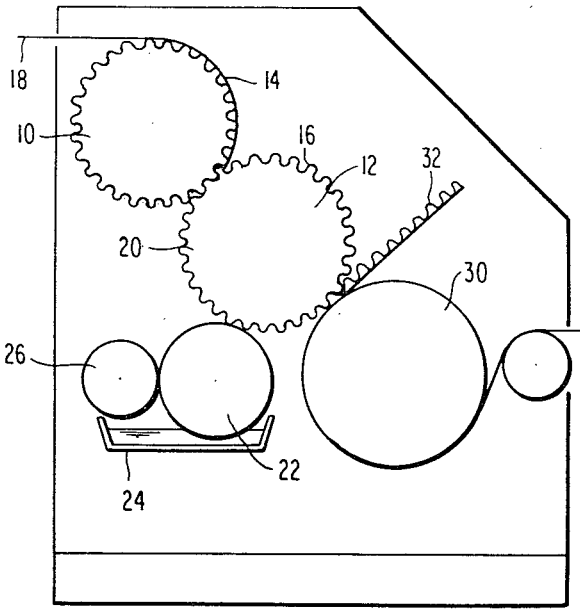
FIG. 1 PRIOR ART
FIG. 2a FIG. 2b
PRIOR ART
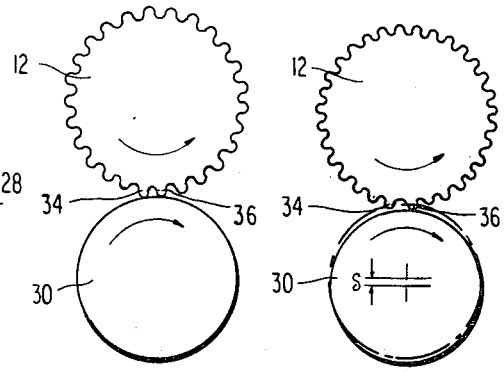
FIG. 3
PRIOR ART
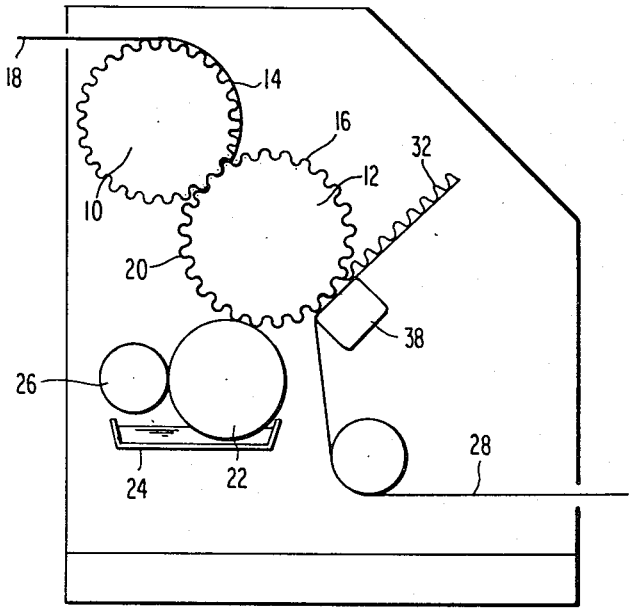
FIG. 4
PRIOR ART
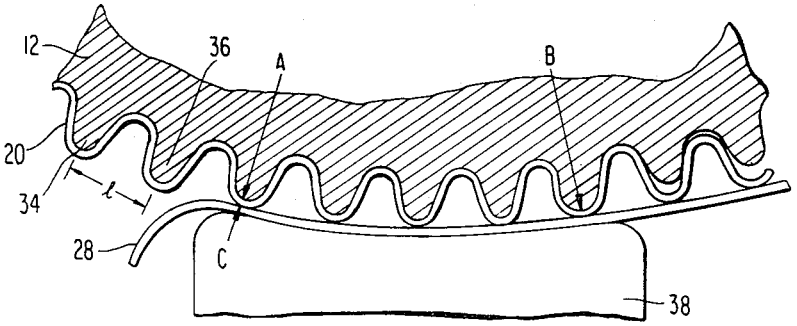

SINGLE FACER

BACKGROUND OF THE INVENTION

1. Field of the Invention

The invention relates to single facers for forming single-faced corrugated board and more particularly to arrangements for effecting bonding of the corrugated web to a liner web to form the single-faced board.

2. Description of the Prior Art

Single facers of the prior art, for example, that shown schematically in FIG. 1 of the accompanying drawings, include conventionally an upper corrugating roll 10 and a lower corrugating roll 12 each of which includes a plurality of longitudinally extending flutes 14 and 16 respectively. The two corrugating rolls are arranged to mesh and the web 18 to be corrugated is supplied between the meshing flutes to form the corrugations therein, the corrugated web being indicated at 20 in FIG. 1.

Conventionally a pasting roll 22, arranged to turn in a bath of paste indicated at 24, is provided for supplying paste to the tips of the corrugated web 20. A doctor roll 26 is provided to control the amount of paste supplied by the pasting roll 22 to the corrugated web 20.

Another web sheet 28, referred to hereinafter as a liner web, is supplied over a pressure roll 30 and brought into engagement with the pasted corrugated web to form the single-faced corrugated board indicated at 32. The pressure roll 30 is positioned adjacent the lower corrugating roll 12 and is arranged to apply pressure to the corrugated web and liner web to effect bonding of these two webs. Normally the upper corrugating roll 10, the lower corrugating roll 12 and the pressure roll 30 are of hollow construction and vapor or high temperature oil is introduced into the internal hollow chamber to heat these rolls and promote the corrugating of the web 18 and the bonding of the corrugated web 20 to the liner web 28.

Prior art apparatus of this type is subject to problems which are best illustrated by reference to FIGS. 2*a* and 2*b* of the accompanying drawing, both of which represent schematically the lower corrugating roll 12 and the pressure roll 30 arranged to bear thereagainst. In FIG. 2*a* two adjacent flutes 34 and 36 are shown in a particular position relative to the pressure roll 30. Turning now to FIG. 2*b* it can be seen that the two rolls 12 and 30 have moved in the direction shown by the arrows in an amount equal to half the distance between adjacent flutes, and flute 34 has moved to a position where it is disposed on a line extending between the centers of the rolls 12 and 30. It can be seen by comparison of FIGS. 2*a* and 2*b* that the aforementioned movement has caused the distance between the shafts of the lower corrugating roll 12 and the pressure roll 30 to be altered so that the distance therebetween has increased by an amount indicated by the dimension $\delta$ in FIG. 2*b*. Because of this forcible displacement and the variation in the distance between the shafts of the two rolls, the cycle of which occurs during an amount of rotation equal to the distance between two adjacent flutes, vibrations occur between the lower corrugating roll 12 and the pressure roll 30. Such relative movement of the two rolls and resulting vibrations not only cause noise but also result in breakage of the corrugated web, when it is of low quality, at the engagement point between the lower corrugating roll and the pressure roll.

In an effort to eliminate such vibration and minimize such breakage of the corrugated web the prior art structure shown in FIG. 3 was developed. The upper and lower corrugating rolls and the pasting roll and associated elements are the same as those shown in FIG. 1 and the same numerals have been applied thereto. However, in the apparatus shown in FIG. 3, a pressure member 38 has been substituted for the pressure roll 30 of the apparatus shown in FIG. 1. This pressure member 38 has a curved or arcuate surface which is opposed to the lower corrugating roll 12 and has a curvature equal to or greater than that of a line extending through the outer surface of the lower corrugating roll, that is through the tips of the flutes of the lower corrugating roll 12. With this construction, the distance between the pressure member 38 and the lower corrugating roll 12 does not vary, and the aforementioned forcible displacement and vibrations of the prior art structure of FIGS. 1 and 2 are eliminated. This can be appreciated by reference to FIG. 4 which illustrates that the distance between the pressure member 38 and the lower corrugating roll 12 does not vary between an engagement point A at the leading edge of the pressure member 38 and an engagement point B at the trailing edge of the pressure member 38, nor at any intermediate point between these two engagement points.

However, the apparatus shown in FIG. 3, while eliminating the aforementioned problem, introduces another problem in the operation of a single facer. The pressure member 38 has a length greater than the distance l between two adjacent flutes 34 and 36 shown in FIG. 4, and the pressure member 38 is fixedly positioned so that the arcuate surface thereof remains fixed while the flutes of the lower corrugating roll 12 move past the surface of the pressure member 38. As a result, a friction force occurs between the liner web 28 and the pressure member 38, and this force is applied to the joints between the liner web 28 and the corrugated web 20 between the engagement points A and B, one such joint being indicated at C in FIG. 4. The result of the application of this frictional force is to cause relative movement between the liner web 28 and the corrugated web 20 and hence to cause separation between these two webs. This results in unsatisfactory bonding and unsatisfactory single-faced corrugated board produced in the apparatus.

In accordance with the present invention, these problems and deficiencies in prior art structures have been overcome and a single facer is provided which manufactures a single-faced corrugated board in which the liner web and corrugated web are effectively bonded.

Accordingly, it is an object of this invention to provide a single facer utilizing a pressure member for effecting bonding of the liner web and corrugated web in which provision is made for minimizing the friction introduced in the area between the pressure member and the adjacent lower corrugating roll.

It is a further object of this invention to provide such an apparatus in which the friction force generated by the liner web and pressure member is reduced so that separation in the joint portions of the liner web and the corrugated web is prevented.

SUMMARY OF THE INVENTION

In carrying out the invention in one form thereof, a pressure member is provided adajcent the lower corrugating roll of a single facer to apply pressure for effecting bonding of the corrugated web and the liner web which pass between the corrugating roll and the pressure member, the liner web being adjacent the surface of the pressure member. The pressure member is provided, in the area facing the lower corrugating wall, with an arcuate surface having a curvature equal to or exceeding that of an arc extending through the tips of the flutes of the corrugating roll. The pressure member is of a circumferential length at least exceeding the distance between two adjacent flutes of the corrugating roll. In order to reduce the friction between the arcuate surface of the pressure member and the liner web passing thereover, a conveyor in the form of an endless belt is disposed with a portion thereof extending between the arcuate surface of the pressure member and the liner web. This portion of the endless belt is movable in the same direction as the periphery of the lower corrugating roll and is movable at a speed equal to the peripheral speed of the lower corrugating roll.

BRIEF DESCRIPTION OF THE DRAWINGS

FIG. 1 is a side elevation view of a schematic representation of a conventional single facer of the prior art.

Figure 5:
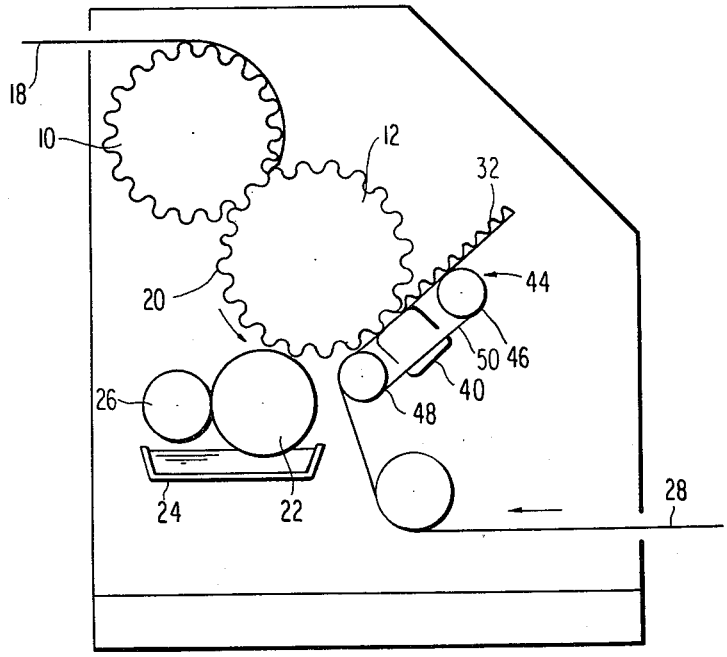
Figure 6:
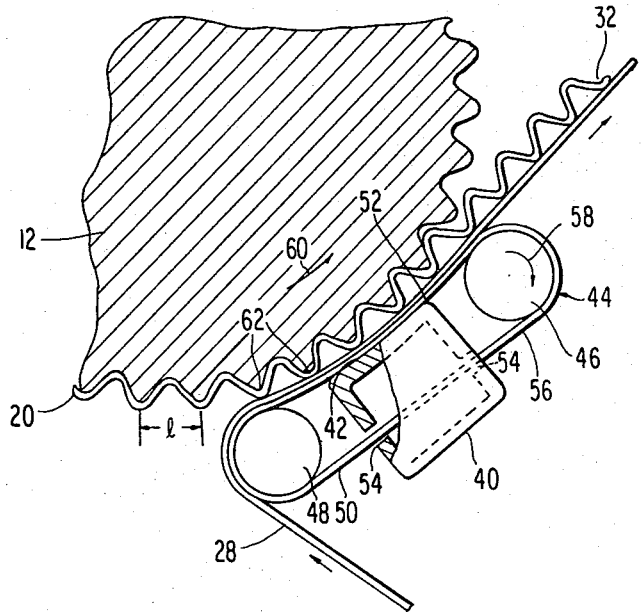

FIGS. *2a* and *2b* illustrate the relative movement of the lower corrugating roll and the pressure roll during operation of the single facer shown in FIG. 1;

FIG. 3 is a side elevation view, also in schematic form, of another conventional single facer of the prior art;

FIG. 4 is an enlarged side elevation view of a portion of the single facer shown in FIG. 3;

FIG. 5 is a side elevation view, in schematic form, of a single facer embodying the presnet invention; and FIG. 6 is an enlarged view, partly in section, of a portion of the single facer shown in FIG. 5.

DESCRIPTION OF THE PREFERRED EMBODIMENT

Referring now to FIGS. 5 and 6, there is shown a preferred embodiment of the present invention incorporated in a single facer of the general type shown in FIGS. 3 and 4. The same numerals have been applied in FIGS. 5 and 6 to components which are identical to those shown in FIGS.3 and 4, and the description of these conventional components will not be repeated here. The embodiment shown in FIGS. 5 and 6 differs from the prior art single facer shown in FIGS. 3 and 4 in the arrangement of the pressure member 40 and the elements associated therewith for reducing the friction between the surface 42 of the pressure member and the liner web 28 passing over this surface as the liner web 28 and the corrugated web 20 are moved between the pressure member and the lower corrugating roll to effect bonding of these webs to form the single-faced corrugated board 32. The pressure member 40 is arranged to exert pressure against the liner web and corrugated web to effect bonding of these webs as they pass between the pressure member and the lower corrugating roll. The surface 42 of the pressure member 40 is arcuate and has a contour substantially conforming to that of an arc extending through the tips of the flutes of the lower corrugating roll 12. The curvature of this arcuate surface 42 is equal to or slightly greater than that of the arc extending through the tips of the flutes of the corrugated roll 12. The pressure member 40 has a circumferential length, that is a length in the direction of the circumference of the lower corrugating roll 12, which is greater than the distance l between two adjacent flutes, for example, flutes 34 and 36 of the lower corrugating roll 12.

As best shown in FIG. 6, the pressure member 40 is of hollow cross-section and this member extends longitudinally of the corrugating roll 12 substantially the full length of the corrugating roll. During operation of the single facer, the liner web 28 passes over the arcuate surface 42 of the pressure member and is normally subjected to friction caused by the movement of the web 28 over this surface. In accordance with this invention, this friction is materially reduced by providing an arrangement which includes a conveyor 44 having a component interposed between the liner web 28 and the arcuate surface 42 of the pressure member 40, which component is movable in the direction of movement of the periphery of the lower corrugating roll 12 and is movable at substantially the same speed as the peripheral speed of the lower corrugating roll 12.

More specifically, the conveyor 44 cummprises two pulleys 46 and 48, positioned on opposite sides of the pressure member 40, and an endless belt 50 which is mounted for movement with the pulleys 46 and 48. It is contemplated that the pulleys 46 and 48 will be mounted on a suitable frame for positioning these pulleys in proper relationship to the pressure member 40 and the lower corrugating roll 12. Since the frame for supporting the pulleys in proper relationship may be of any conventional structure readily apparent to those skilled in the art, it has been omitted from the drawing for the sake of simplicity and clarity. If desired, the same frame could also be employed as a support for the pressure member 40.

The endless belt 50 is arranged, as shown in FIG. 6, so that a portion 52 thereof is at all times interposed between the liner web 28 and the arcuate surface 42 of the pressure member 40. In the form of the invention shown in FIG. 6, the pressure member 40 is provided with slots 54 in opposite walls thereof for receiving the return portion 56 of the endless belt travelling from the pulley 46 to the pulley 48. This provides a convenient return movement for the endless belt, because of the relative size of the pulleys and the pressure member in the form of the invention illustrated. It will be apparent, however, that where different size relationships are involved, the portion 56 of the endless belt 50 may simply extend below the pressure member 40 so that the slots 54 would be rendered unnecessary.

The pulley 46 is driven by any suitable means, such as a conventional electric motor, in the direction of the arrow 58 to move the portion 52 of the endless belt 50 in the same direction as the direction of movement of the periphery of the lower corrugating roll 12, indicated by the arrow 60. The pulley 46 is driven at such speed that the speed of movement of the portion 52 of the belt is equal to the peripheral speed of the lower corrugating roll 12. Thus, the friction between the liner web 28 and the surface 42 of the pressure member, which presented a problem with the prior art structure illustrated in FIGS. 3 and 4, is substantially eliminated. Therefore, the tendency of this friction to cause separation of the liner web 28 and the corrugated web 20 at the joints 62 is also substantially eliminated. This insures effective bonding of the liner web 28 and the corrugated web 20 at these joints and thereby insures production of a satisfactory single-faced corrugated board 32.

While a particular structure of this invention has been illustrated and described, it will be apparent that the invention is not limted to the specific structure so shown and described and that modifications will occur to those skilled in the art. It is intended, therefore, by the appended claims to cover all such modifications as come within the spirit and scope of this invention.

What is claimed is:

1. In a single facer including a corrugating roll having flutes extending along its peripheral surface for forming a corrugating web, (a) a pressure member opposed to said corrugating roll for pressing a liner web against the corrugated web to form a single-faced board;

(b) said pressure member having an arcuate surface substantially conforming to the contour of an arc extending through the tips of said flutes and having a length in the circumferential direction of said roll which is greater than the distance between two adjacent flutes thereof; and (c) a movable conveyor interposed between said arcuate surface of said pressure member and the liner web;

(d) said conveyor being movable in the same direction as the periphery of said lower corrugating roll and being movable at a speed equal to the peripheral speed of said lower corrugating roll.

2. The apparatus of claim 1 wherein said conveyor comprises an endless belt, a portion of said endless belt extending between said arcuate surface of said pressure member and the liner web.

3. The apparatus of claim 1 wherein said conveyor comprises:

(a) a plurality of spaced pulleys disposed on opposite sides of said pressure member; and (b) an endless belt extending over said pulleys and having a portion extending between said arcuate surface of said pressure member and the liner web;

(c) said endless belt in the region between said pressure member and the liner web being movable in the same direction as the periphery of said lower corrugating roll and being movable at a speed equal to the peripheral speed of said lower corrugating roll.

* * * * *